United States Patent [19]

Okamato et al.

[11] 4,236,471

[45] Dec. 2, 1980

[54] COLOR COOLED PRESSER FEET

[75] Inventors: Toshiaki Okamato, Okazaki; Hideo Nawa, Chiryu, both of Japan

[73] Assignee: Aisin Seiki Kabushiki Kaisha, Kariya, Japan

[21] Appl. No.: 17,962

[22] Filed: Mar. 6, 1979

[30] Foreign Application Priority Data

Mar. 31, 1978 [JP] Japan ..... 53-43165[U]

[51] Int. Cl.[3] ..... D05B 29/12

[52] U.S. Cl. ..... 112/240; 112/158 C

[58] Field of Search ..... 112/240, 235, 236, 158 R, 112/158 F, 222

[56] References Cited

U.S. PATENT DOCUMENTS

| | | | |
|---|---|---|---|
| 2,706,460 | 4/1955 | Grossman | 112/235 |
| 3,233,569 | 2/1966 | Euguchi | 112/235 X |
| 3,254,618 | 6/1966 | Eguchi | 112/158 C |
| 3,489,114 | 1/1970 | Seck | 112/240 |
| 3,656,443 | 4/1972 | Ross | 112/235 |
| 3,854,433 | 12/1974 | Hanyu | 112/235 |
| 4,052,946 | 10/1977 | Rydz et al. | 112/158 E |
| 4,055,131 | 10/1977 | O'Brien et al. | 112/158 E |
| 4,079,683 | 3/1978 | Hanyu et al. | 112/158 F |
| 4,117,791 | 10/1978 | Current et al. | 112/222 |

FOREIGN PATENT DOCUMENTS

| | | | |
|---|---|---|---|
| 919973 | 2/1963 | United Kingdom | 112/158 F |

*Primary Examiner*—Werner H. Schroeder
*Assistant Examiner*—Andrew M. Falik
*Attorney, Agent, or Firm*—Oblon, Fisher, Spivak, McClelland & Maier

[57] ABSTRACT

A sewing machine is provided for stitching an ornamental stitch produced by an ornamental stitching pattern control arrangement for the purpose of setting the character and pattern of the needle movements. The sewing machine provides a stitching pattern selection device including manipulating select buttons classified according to color, and a presser attachment including a variety of presser feet having color indications corresponding to the color of the select buttons.

5 Claims, 6 Drawing Figures

COLOR COOLED PRESSER FEET

BACKGROUND OF THE INVENTION

1. Field of the Invention

The present invention relates to sewing machines and more particularly to a sewing machine having an ornamental stitching pattern control arragnement for the purpose of setting the character and pattern of the lateral movements of the needle and regulating the feed velocity and stitch length of the cloth. Such sewing machines also have a stitching pattern selection device and presser attachments corresponding to the stitching patterns.

2. Description of the Prior Art

U.S. Pat. No. 4,055,131 granted on Oct. 25, 1977 to O'Brien et al teaches an electronic stitching pattern control arrangement for use in sewing machines having a push button and a manipulatable dial for selection of a stitching pattern. An indicating arrangement for use in sewing machines having a table for selecting a pressing attachment in accordance with associated desired stitching patterns is also disclosed in U.S. Pat. No. 4,079,683 granted on Mar. 21, 1978 to Hanyu et al.

According to such conventional types, the sewing machines have several pressers or other attachments which are to be selected upon use of such table by the operator. However, the selection of the pressing attachment corresponding to the desired stitching pattern is very complicated.

SUMMARY OF THE INVENTION

It is a principal object of the present invention to provide a sewing machine having an ornamental stitching pattern control arrangement wherein the difficulties of the conventional sewing machines may be resolved.

It is another object of the present invention to provide a sewing machine having a presser attachment indicating the color corresponding with the color of the desired stitching pattern selector button.

It is a further object of the present invention to provide an enhanced appearance by the color indication.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED EXPLANATION OF THE INVENTION

Figure 1:
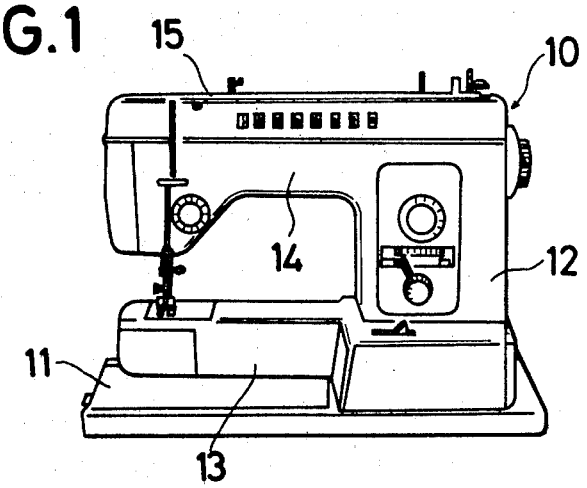
FIG. 1 is a front elevational view of a sewing machine incorporating the present invention.
Figure 3:
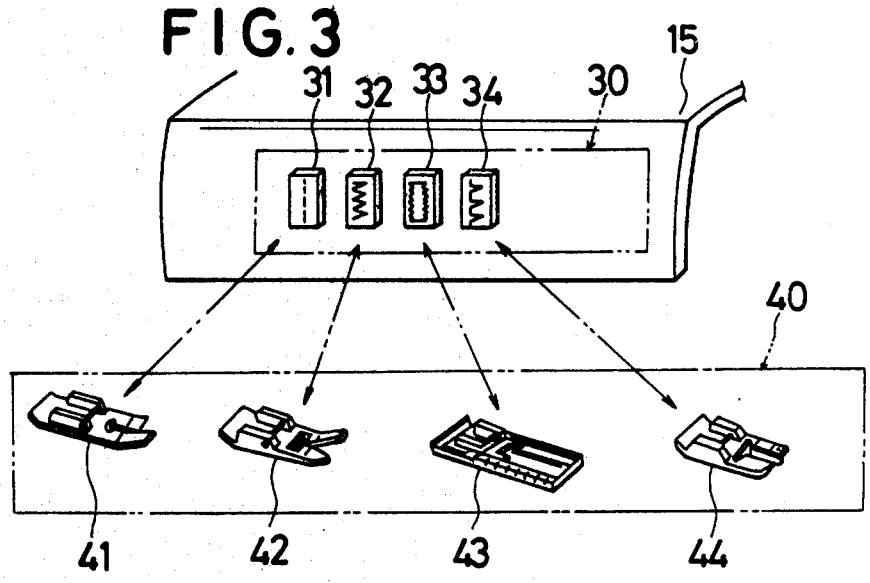
FIG. 3 is a partially perspective view explaining the correspondence of the presser attachments with the stitching pattern selection buttons of the sewing machine.
Figure 2:
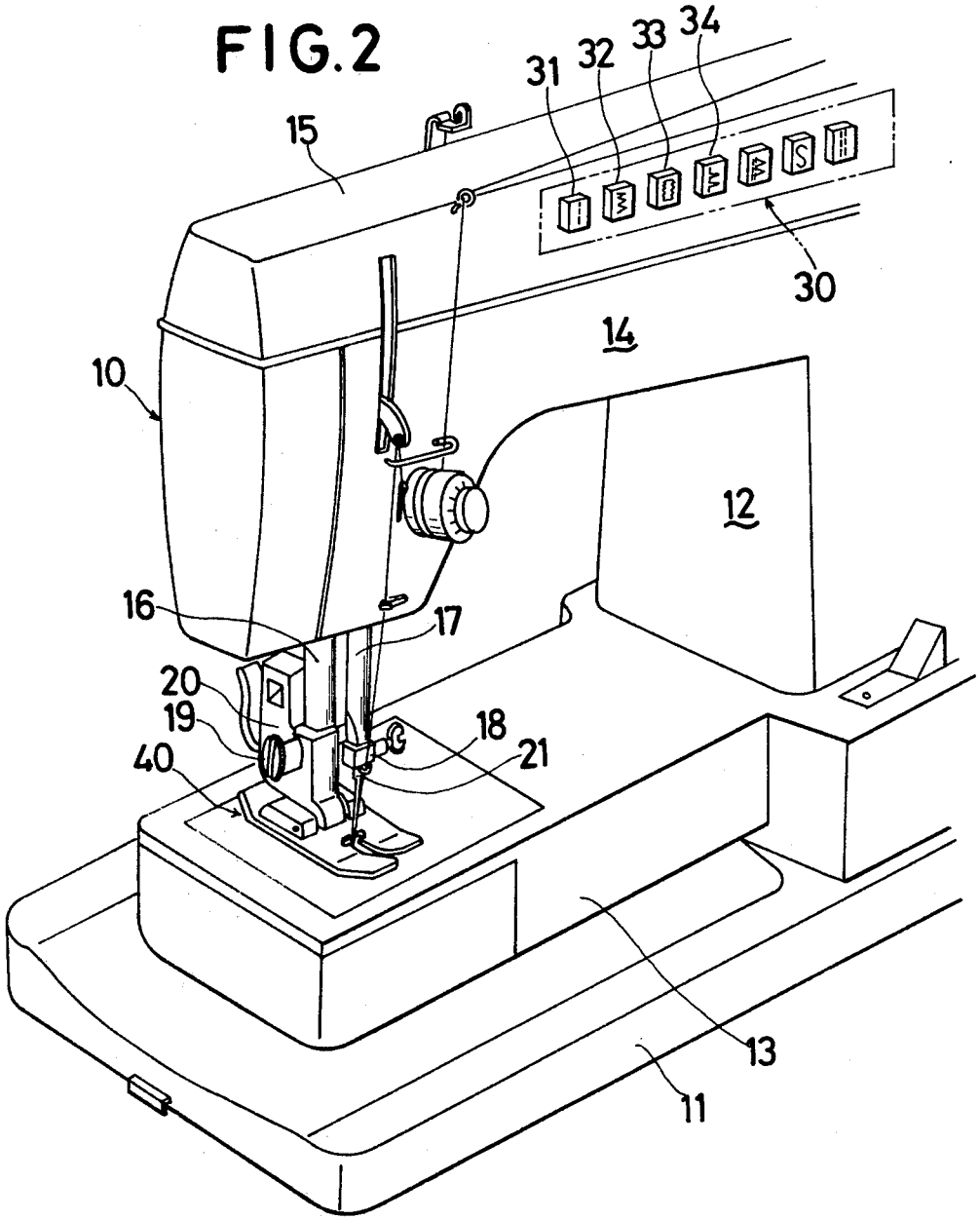
FIG. 2 is an enlarged partially perspective view of the sewing machine of FIG. 1.

Referring to the drawings, a sewing machine 10 includes a substantially rectangular shaped base 11 upon which is mounted a transversely disposed hollow free arm bed 13. The bed 13 supports a standard 12 from which extends a bracket arm 14 overhanging the free arm bed 13. The bracket arm 14 is covered by a top cover provided with a stitching pattern selection device 30 as shown in FIGS. 2 and 3. A needle-bar 17 carrying a needle 21 by a needle clamp 18 is mounted on the bracket arm 14. A presser attachment 40 is held on a connecting member 20 which is connected with a presser bar 16 by clamp screw 19. An ornamental stitching pattern control arrangement (not shown) housed within sewing machine 10 is provided for regulating the vertical reciprocation and the lateral movements of the needle-bar 17, thereby setting the character and pattern of the needle movements of the needle 21.

The stitching pattern selection device 30 comprises a plurality of manipulating selection buttons such as a straight stitching button 31, a zig zag stitching button 32, button holing button 33, and a blind stitching button 34. Each of such selection buttons is classified by the various color indications. The color indication of such selection buttons comprises the painting on the whole of the button, a symbol of the stitching pattern on the button and/or a lamplight color in a crest of the button.

Figure 4:
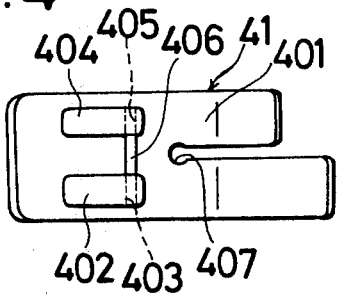
FIG. 4 is an enlarged plan view of one embodiment of the presser foot at shown in FIG. 3.
Figure 5:
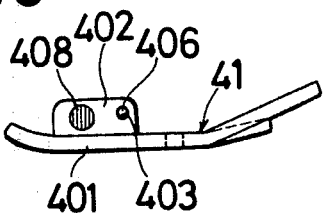
FIG. 5 is a front elevational view of the presser foot of FIG. 4.
Figure 6:
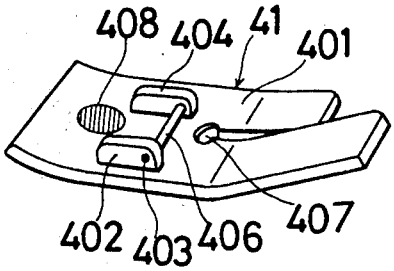
FIG. 6 is an enlarged perspective view of a modified embodiment of the presser foot of the present invention.

The presser attachment 40 includes a variety of presser feet such as a straight stitch foot 41, a zig zag stitch foot 42, a buttonhole foot 43, and a blind stitch foot 44. The presser foot 41 of the presser feet is clearly shown in FIGS. 4–6 which comprises a plate 401, two projections 402 and 404, a pin 406, a needle hole 407, and color indication 408. The projections 402 and 404 are formed continuously from the upper face of the plate 401 and are parallel to each other. One end of the pin 406 is inserted by pressure in a hole 403 of the projection 402 and the other end of the pin 406 is inserted by pressure in a hole 405 of the projection 404. The pin 406 is engageable with the connecting member 20. Therefore, the presser foot 41 is connected with the presser bar 16 through connecting member 20. The color indication 408 is painted on and positioned at a suitable portion of the outer side wall of the projection 402 as shown in FIG. 5. The indicated position of the color indication is not only the outer side wall of the projection 402 but also the one end of the pin 406 or substantially surrounding portion thereof between the one end of the pin 406 and the hole 402. The color indication may be positioned at each of the projections 402 and 404 and also the color indication might also be as well positioned at a suitable portion of the upper face of the plate 401 as shown in FIG. 6. The color of the color indication 408 is arranged corresponding with the color of the straight stitching button 31. Such color is indicated so as to correspond with the stitching pattern. Similarly, each of the other presser feet 42 to 44 corresponds with each of the selection buttons 32 to 34 as shown by the arrows in FIG. 3.

As an example, the color indication of the presser foot can be arranged corresponding with the color of the select button as follows:

red: straight stitching button 31⟷straight stitch foot 41 orange: zigzag stitching button 32⟷zigzag stitch foot 42 blue: buttonholing button 33⟷buttonhole foot 43 yellow: blind stitching button 34←→blind stitch foot 44.

Consequently, the operator can easily select the presser foot corresponding to the desired selection button from a variety of presser feet by such color indications.

As clearly stated above, it will be seen that the several objects of the invention may be achieved, and other advantageous results may be obtained.

Obviously, many modifications and variations of the present invention are possible in light of the above teachings. It is therefore to be understood that within the scope of the appended claims the invention may be practiced otherwise than as specifically described herein.

We claim:

1. A sewing machine for stitching an ornamental stitch produced by an ornamental stitching pattern control arrangement provided therein comprising:

a stitching pattern selection means mounted on said sewing machine including a plurality of manipulating selection buttons classified in accordance with the color thereof; and presser means including a plurality of presser foot members having color indications corresponding with the colors of said selection buttons for indication of stitching pattern according to color indication.

2. A sewing machine according to claim 1 wherein said color indication of said selection buttons is arranged in accordance with a corresponding stitching pattern.

3. A sewing machine according to claim 1 wherein said color indication of said selection buttons comprises a painting on the whole of said selection buttons.

4. A sewing machine according to claim 2 wherein said color indication of said selection buttons comprises painting of a symbol of said stitching pattern of said selection buttons thereon.

5. A sewing machine for stitching an ornamental stitch produced by an ornamental stitching pattern control arrangement provided therein comprising:

a stitching pattern selection means mounted on said sewing machine including a plurality of manipulating selection buttons classified in accordance with the color thereof; and presser means including a plurality of presser foot members having color indications corresponding with the colors of said selection buttons for indication of stitching pattern according to color indication wherein said sewing machine includes a presser bar and each of said presser foot members includes a pressing plate, support portions formed continuously from an upper face of said plate and substantially parallel to each other, a pin member connected between said support portions and connected to said presser bar, a needle hole formed in said plate, and a color indication painted at a suitable portion of an outer side wall of at least one of said support portions.

* * * * *